United States Patent [19]

Bergstrom

[11] 3,997,169

[45] Dec. 14, 1976

[54] BALL RETRIEVER ATTACHMENT

[76] Inventor: Harold G. Bergstrom, 85 Wiltshire Road, Scarsdale, N.Y. 10583

[22] Filed: Sept. 22, 1975

[21] Appl. No.: 615,468

[52] U.S. Cl. ..... 273/162 E; 294/19 A

[51] Int. Cl.[2] ..... A63B 57/00

[58] Field of Search ..... 273/32 F, 162 E, 193 R, 273/194 R, 194 A; 294/19 A; 150/52 G

[56] References Cited

UNITED STATES PATENTS

| | | | |
|---|---|---|---|
| 1,431,968 | 10/1972 | McDermott | 294/19 A |
| 2,448,644 | 9/1948 | Williams | 294/19 A |
| 2,489,958 | 11/1949 | Douglass | 294/19 A |
| 2,523,942 | 9/1950 | Ciambriello | 294/19 A |
| 2,561,815 | 7/1951 | Oberg | 294/19 A |
| 2,737,394 | 3/1956 | Abel | 273/194 B |
| 2,802,687 | 8/1957 | DuChene | 273/162 E X |
| 3,058,767 | 10/1962 | Baker | 294/19 A |
| 3,210,111 | 10/1965 | Fallon | 273/162 E X |
| 3,593,769 | 7/1971 | Spears | 150/52 G |
| 3,749,407 | 7/1973 | Prochnow | 273/162 E |
| 3,773,374 | 11/1973 | D'Luhy | 294/19 A |
| D216,138 | 11/1969 | Carignan | 273/162 E X |

*Primary Examiner*—Richard J. Apley

[57] ABSTRACT

This invention relates to a plastic, scoop-like device which easily, and without the use of tools, attaches to a golfclub iron, for the purpose of retrieving golf balls, or the like, from water hazards or other relatively inaccessible locations, or to pick up golf balls after a practice session. This device has two sides, bottom, and open ends, which is formed by bending a flat sheet of relatively thin plastic, permanently secured at its center top edge, which will cause it to resemble a "tear-drop" shape in its cross-section from that point of securement to one end of the device. From that same point of securement to the other end of the device, the cross-sectional shape fairs from the "tear-drop" shape to a form resembling a "U" in cross-section. The latter end of the device receives the "scooped" ball and the former end receives and attaches to the club head. The "scoop" end has two holes, each being of a smaller diameter than that of a golf ball, and are so designed as to engage the golf ball on both sides and to hold the ball during, and after the scooping action, to retrieve the ball from its unwanted location. The other end of the device envelops the golf club head, and when secured with the fastener to the club head, it forms an integral unit with the club shaft, and as such, forms the complete retriever.

3 Claims, 5 Drawing Figures

FIG.1.
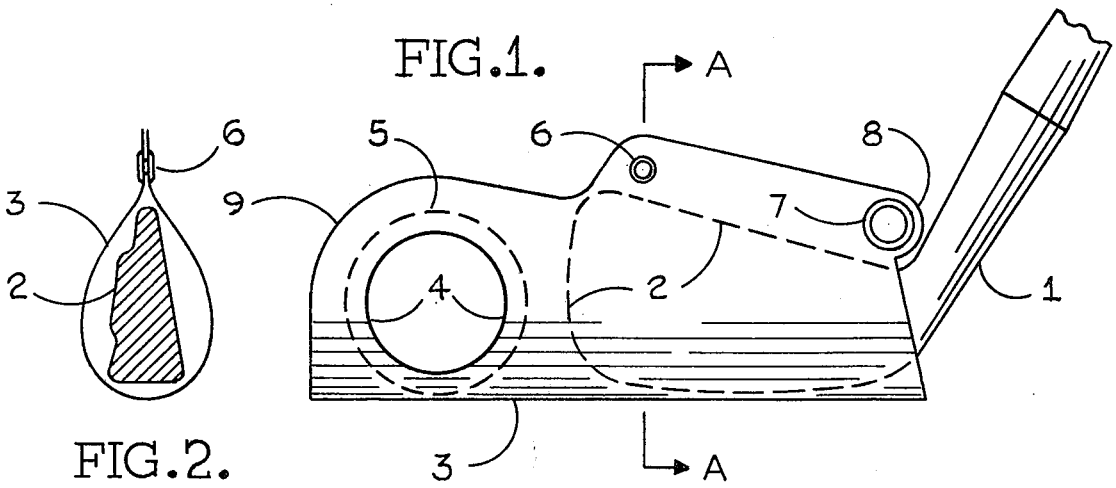
FIG.2.
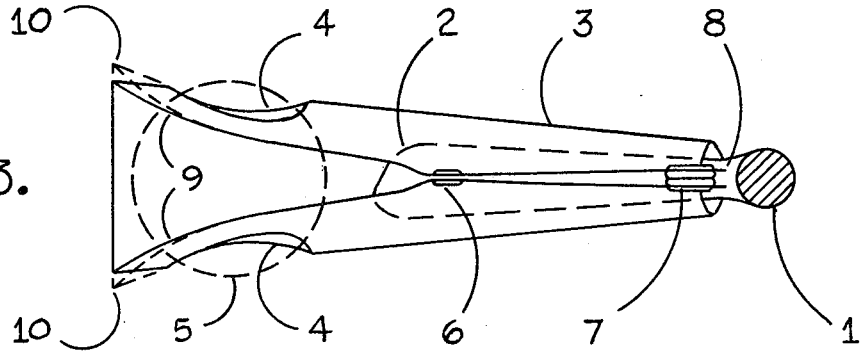
FIG.3.
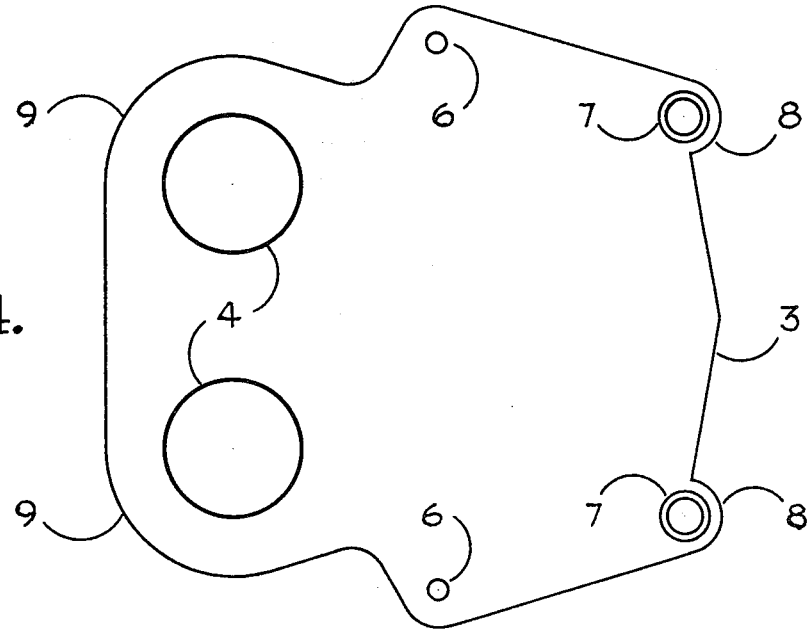
FIG.4.

BALL RETRIEVER ATTACHMENT

SUMMARY OF THE INVENTION

This invention relates to a scoop-like device which attaches to a golf club iron, and more particulary to an improved device for retrieving golf balls, or the like.

The device consists generally of two useful ends; the one end which attaches to the head of the golf club iron, and the other end which is used to "scoop" the ball, or the like, out of the hazard or any other unwanted location.

The end which attaches to the club has a "fixed" fastener, and a "detachable" fastener. The purpose of the latter is to provide for the entrance of the wider end of the club head to pass into the device until it has reached its most entrant position, at which point it may then be secured onto the club head by engaging the detachable fastener. A certain allowance, or "play" is designed into the device to allow for the variance of club head designs, so that the user can select the iron club head which best fits the device, and that which will best suit the user.

The device performs its designed function on either right, or left-handed golf club irons.

The device is designed for use on the long golf club irons such as the No. 1, No. 2, No. 3, or No. 4 irons because of their relatively upright blades and long handles, rather than for use on the golf club "woods" for such retrieving action, since the "woods" may be permanently damaged by prolonged immersion in water, or by the abrasive action of rough objects in the hazard.

The device is so designed, that the detaching of the device is easily accomplished by putting the thumb of one hand through the ball retriever holes, and holding the club hosel with the other hand, pull the device off the club head with a "snap action" thus forcing open the detachable fastener, without causing harm to the device, club head, or the fastener.

This invention overcomes the disadvantages of the prior art by providing a retriever attachment that is less expensive to manufacture, easy to attach or detach from the golf club iron head without involving any other part of that club, easy to clean, light-weight, requires a minimum of storage space, durable, of minimum size, and may be readily carried in a pocket, left on the club, or attached to a belt or golf bag. An important object of the invention is to provide an accessory that is an improvement of prior art which facilitates the retrieving of golf balls, and the like, from water hazards and other relatively inaccessible locations, with a minimum of time and effort.

Another object of the invention is to provide a device that is compact and light in weight, which may be conveniently carried in a pocket or snapped onto a belt, and which may be easily and quickly attached to a golf club without the use of tools and without marring or otherwise damaging the club, or to whatever it is attached to, or contained in.

Another object of the invention is to provide a device which is the least obtrusive of prior art. This is of importance to golfers who feel that the showing of a retriever among their golf clubs somehow reflects on their prowess, and presupposes their inability to avoid hazards.

Another object of the invention is to provide a device which will easily and convenienty pick up golf balls that have been hit into fairways and roughs during practice sessions, to retrieve other small objects such as purses, keys, or the like, that have inadvertently been dropped into hazards or otherwise unreachable places. The device could also be used for the picking up of stones, shells, and the like, found to be of interest to collectors.

Shape forms and outlines, together with the placement of the fasteners, all contribute support to the proper functioning of the retriever.

I am aware, that details of construction may be varied and I therefore, do not propose limiting the patent hereon granted other than as indicated by the scope of the appended claims.

BRIEF DESCRIPTION OF THE DRAWINGS

The invention (in a preferred form) is shown on the drawings wherein:

FIG. 1 is a side elevation showing a golf club head with the improved ball retriever of this invention attached thereto;

FIG. 2 is a cross-sectional view of the device illustrated in FIG. 1, and taken on the line A-A thereof, showing the relative position of the club head therein;

FIG. 3 is a top view of the device showing the relative position of the club head when attached to the device and a golf ball in its most entrant position.

FIG. 4 is a view of the device in its initial, die-cut, flat form, before it has been bent into its final shape.

DETAILED DESCRIPTION OF THE DRAWINGS

Figure 5:
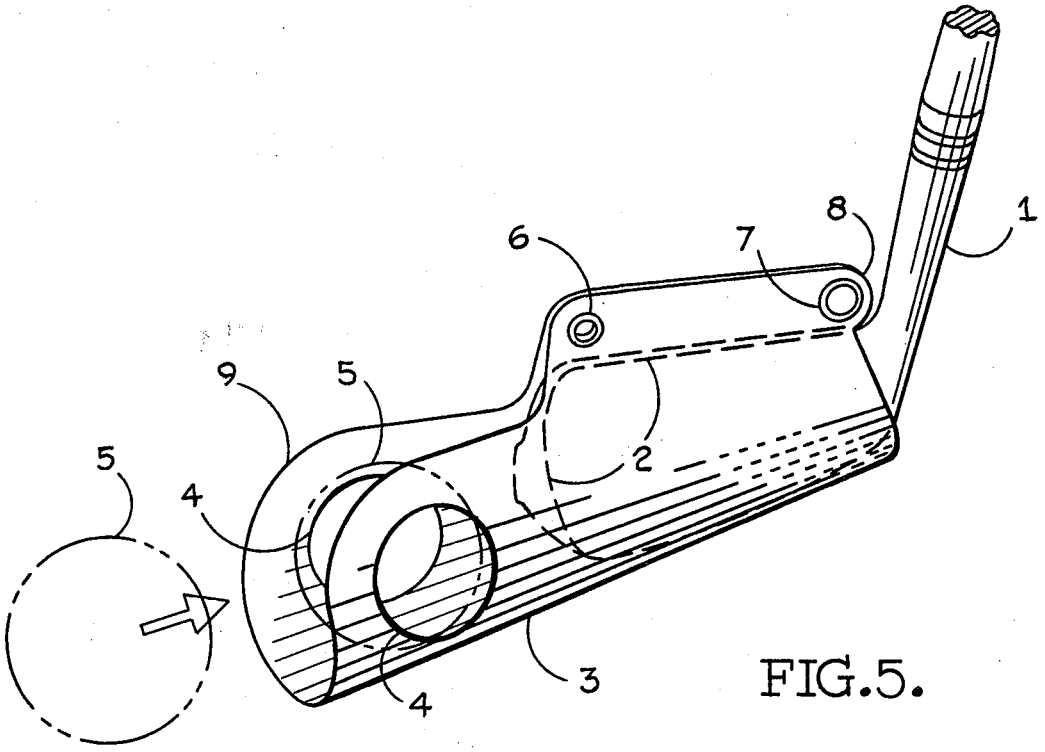
FIG. 5 is a perspective view looking at the device from the left of FIG. 1 showing a golf ball about to be retrieved, and that same ball in its most entrant position at retrievement.

As shown on the drawings, the reference numeral 1 designates the hosel of a golf club shaft that is connected to a head or blade 2, to which the retriever device 3 is attached thereto, as shown on FIGS. 1, 2, 3, and 5.

The retriever device 3, of this invention consists of a single piece of relatively thin sheet of flexible plastic such as high density polyethylene, polyester (PE terephthalate) or similar plastics which are well known to the art and which are capable of being die-cut, remaining flexible, remain impervious to moisture and temperature ranges normally encountered at golf courses, easily cleaned, and can withstand normal abuse without damage.

The two holes 4 are of a diameter smaller than the largest cross-sectional diameter of a golf ball 5 and so designed as to engage the golf ball on both sides, and to hold the ball after the ball has reached its most entrant position. Drainage from the device is accomplished by the deforming of the holes 4 before and after the ball reaches its most entrant position, and also at the remaining space between the engaged club head and the walls of the "tear-drop" cross-section of the device.

The cross-sectional "tear-drop" form of the device 3, as shown in FIG. 2, on the drawings, is held in this form by the "fixed" fastener 6. The device is secured to the club head 2 by the "detachable" fastener 7 so that the device is secured to the club head 2 adjacent to the hosel 1 to prevent the retriever from being disengaged in the hazard from which the ball is being retrieved. The plastic shaping 8 around the fastener 7, is so designed as to prevent the hosel 1 from accidently opening the fastener 7. FIG. 3 illustrates that the flanges 9, of the scoop end of the device, are so designed that they will diverge, as shown at position 10, at the initial entry of the ball into the device and return to their original form after the ball has reached its most entrant position, thus adding to the holding action of the two holes 4 on the golf ball 5.

The device may be easily cleaned of any debris encountered during the retrievement. After removing the retrieved ball from the device, the device may be quickly rinsed in the water hazard, and because of the smooth surfaces of the device, shaken to remove any of the droplets of water remaining on the surfaces and the fasteners.

Installing the device on the club head is easily accomplished. The fastener 7 is opened, the club head 2 is inserted into the device until the hosel 1 has reached a point just short of the shaping 8, then the fastener 7 is engaged, securing the device to the club head iron 2.

I claim:

1. In combination, a golf ball retriever attachment and a golf club having a shaft, a hosel fitting about the free end portion of said shaft, and a tapered metal blade extending from said hosel with a front striking face and a rear face, having a sole adapted to lie parallel to the ground, a top surface tapering outwardly with respect to the sole as it extends from the hosel, and the blade tapering to converge from the sole to the top surface thereof, said ball retriever attachment comprising, a scoop-like device having an elongated, flexible sheet plastic body in the form of an open ended sleeve, or sheath, tapered in respect to its longitudinal or horizontal axis, of a size to accommodate said blade of a golf club iron within its minor end, and extending longitudinally of the club head and beyond the free end thereof, of a size and length to hold a golf ball within the major end of said sleeve, said tapered sleeve having a semi frusto-conical bottom, with side walls having generally plane surfaces which taper upwardly from opposite sides of said bottom to meet in convergence at their matching outermost edges and held in said convergence by a fastener at their medial top edges, said fastener causing a holding action on said top surface of said club blade, said top edges having at the minor end of the device a separable fastener and a cooperating fastener for removably securing the device to the blade of the golf club iron adjacent to said hosel, said top edges diverging from said medial fastener toward the major end of device, each independently and symmetrically merging in concurrent lines with the major end edges of said side walls and said bottom edge, and thus forming a scoop-like opening of a size to accommodate the ready scooping of a golf ball from water and the like, said major end side walls each having a symmetrically disposed holding hole, on a common transverse axis, of a diameter generally less than that of a golf ball, to drain the water scooped up with a golf ball and to engage and hold the golf ball, during and after its retrievement, said retrievement being accomplished by movement of the device toward the golf ball, with said major end leading the blade of the club, generally parallel to the longitudinal axis of the device, and said blade of the club, positioning of said device varying from close-at-hand retrievement wherein said bottom of the device will be generally parallel to the ground or hazard bed, to maximum reach retrievement wherein one of said side walls of the device will be generally parallel to the ground or hazard bed, said flexibility of said device and its minimum size and minimum weight enable said device to be readily carried on the user's person or in the pocket of a golf bag without danger of deforming its functional form.

2. The golf ball retriever attachment of claim 1, wherein the plastic material is of high density, high tensile strength polyester of sufficient flexibility to fit removably and slidably on the blade of a golf club iron without the use of tools.

3. The golf ball retriever attachment of claim 1, wherein both said fasteners are separable fasteners, each having a cooperating fastener whereby the device may be restored to its original flat form to reduce its volume displacement, in storage, when not in use as a golf ball retriever.

* * * * *